United States Patent [19]

Ogden

[11] 4,344,616

[45] Aug. 17, 1982

[54] EXERCISE TREADMILL

[76] Inventor: Ralph Ogden, 1304 Fisher St., Munster, Ind. 46321

[21] Appl. No.: 175,516

[22] Filed: Aug. 5, 1980

[51] Int. Cl.[3] ..... A63B 23/06

[52] U.S. Cl. ..... 272/69; 272/DIG. 4

[58] Field of Search ..... 272/69, 144, 145, DIG. 4; D21/192

[56] References Cited

U.S. PATENT DOCUMENTS

| | | | |
|---|---|---|---|
| D. 211,801 | 7/1968 | Quinton | D21/192 |
| 759,296 | 5/1904 | Morairty | 272/69 |
| 3,643,943 | 2/1972 | Erwin, Jr. et al. | 272/69 |
| 3,659,845 | 5/1972 | Quinton | 272/69 |

FOREIGN PATENT DOCUMENTS

| | | | |
|---|---|---|---|
| 1565616 | 3/1969 | France | 272/69 |
| 1565617 | 3/1969 | France | 272/69 |
| 221620 | 8/1942 | Switzerland | 272/69 |

*Primary Examiner*—Richard J. Apley
*Assistant Examiner*—Arnold W. Kramer
*Attorney, Agent, or Firm*—McWilliams, Mann & Zummer

[57] ABSTRACT

A treadmill exercising apparatus comprising a generally planar frame equipped with a planar slider bed and head and tail rollers journalled respectively at the head and tail ends of the frame, which rollers are formed from steel and are provided with elastomeric material crowns, over which rollers an endless nylon belt is trained, with the slider bed having a dry canvas top surfacing across which the upper run of the belt rides, and with the frame at its head end being equipped with a cross member in which are threadedly mounted in spaced apart relation a pair of threaded screw members that adjustably support the head end of the frame, with each of said screw members being journalled in its own foot for rotational movement with respect thereto, and with the threaded screw members being coupled together adjacent their upper ends for simultaneous manual operation in the same direction in forward and reverse directions. The screw members shift from an angled position to a substantially vertical position, in firm supporting relation to the treadmill frame, when operated to shift the treadmill frame from horizontal position to the maximum grade effect position.

7 Claims, 13 Drawing Figures

EXERCISE TREADMILL

This invention relates to an exercise treadmill, and more particularly to an exercise treadmill of the endless belt type.

Various forms and types of treadmill assemblies are available for exercise purposes involving endless belts. However, most commercially available equipment of this type is unduly expensive to be practical for individuals to have for home use, due to the tendency to incorporate sophisticated monitoring equipment and overdesign the basic apparatus to insure continuous exercise for individuals weighing up to two hundred fifty pounds or more and yet permit adjustment in slope and speed for making available to the user mild to exhaustive exercise for testing or conditioning purposes.

A principal object of the present invention is to provide a walking exercise treadmill of few and simple parts that avoids costly sophisticated instrumentation and other equipment not essential to exercise use as such, while providing the user with ready infinitely variable slope adjustment between zero and a predetermined maximum, such as twenty-five percent, and a suitable selection of belt speed adjustments.

Another principal object of the present invention is to provide an exercise treadmill that essentially comprises a slider bed type, endless belt trained, frame assembly providing for manually operable stepless slope selectability between zero and a predetermined maximum slope, with the frame support being arranged to automatically increase stability as the slope is increased to the maximum provided for.

Another important object of the invention is to provide an exercise treadmill that has minimal space requirements for storage and use, that has nominal maintenance requirements, and that is long lived and effective in use.

In accordance with the invention, an exercise treadmill is provided comprising a generally planar frame providing a slider bed, and head and tail rollers at the corresponding ends of the slider bed, over which is trained an endless belt that may be formed from nylon or the like, the upper run of which rides on a lubrication free canvas facing of the slider bed. The treadmill frame adjacent to and spaced forwardly of its head end is provided with a cross member in which slope adjusting devices are provided comprising a pair of spaced apart screw members that are threadedly mounted for supporting and changing the elevation of the frame head end to provide the slope, if any, desired. Each screw member is individually journalled in its own supporting foot that is arranged for rocking relation of the screw members with respect to the treadmill supporting surface for the treadmill feet, and the screw members are mounted for rotation about upright axes that are at like acute angles with respect to the plane of the slider bed, which axes angle forwardly of the treadmill upwardly of the slider bed frame. The indicated acute angulation of the screw member axes equal the maximum angulation the slider bed frame is to have at its maximum slope to be provided for, which is twenty-five percent in a preferred embodiment of the invention. The upper ends of the screw members are coupled together by a manually operated drive chain arrangement for adjusting the elevation of the treadmill head end to provide the slope desired up to the indicated maximum slope. The chain drive is protected by a cover that journals the upper ends of the respective screw members for maintaining the upper ends of same in coplanar relation with the frame cross member and in parallelism for effective simultaneous rotating action. The tail end of the treadmill frame is equipped with a pair of spaced feet, and the treadmill feet at both ends of the frame are proportioned so that the treadmill slider bed and cooperating endless belt are horizontally disposed when the screw members are in their retracted positions, with the slider bed and cooperating belt being angled upwardly at the predetermined maximum slope to be provided by the treadmill unit when the screw members are in their extended, substantially vertical relations.

The belt is power driven by a suitable electric motor carried by the treadmill frame cross member with stepped pulleys being provided for stepping down of the drive RPM and belt speed adjustment to provide belt movement at several selected speeds, such as 2.5, 3, and 3.5 miles per hour for walking exercise. The treadmill assembly or unit is equipped at and across its head end with a hand hold railing of inverted U shaped configuration of which the bight of the railing crosses the head end of the treadmill for grasping as needed by the user.

Hand crank operation of the screw members from their retracted relations to their extended positions both swings the screw members to a substantial vertical supporting position without changing their angular relationship relative to the treadmill slider bed, and angles the treadmill slider bed and endless belt trained thereover at the desired maximum slope provided for, which is at the same acute angle relative to the horizontal that the screw member axes are angled relative to the plane of the treadmill slider bed.

Still other objects, uses and advantages will become obvious or apparent from a consideration of the following detailed description and the application drawings in which like reference numerals indicate like parts throughout the several views.

However, it is to be understood that the specific drawing illustrations provided are supplied primarily to comply with the requirements of the Patent Laws, and that the invention is susceptible of modifications and variations that will be obvious to those skilled in the art, and which are intended to be covered by the appended claims.

Figures 1, 2, 2A:
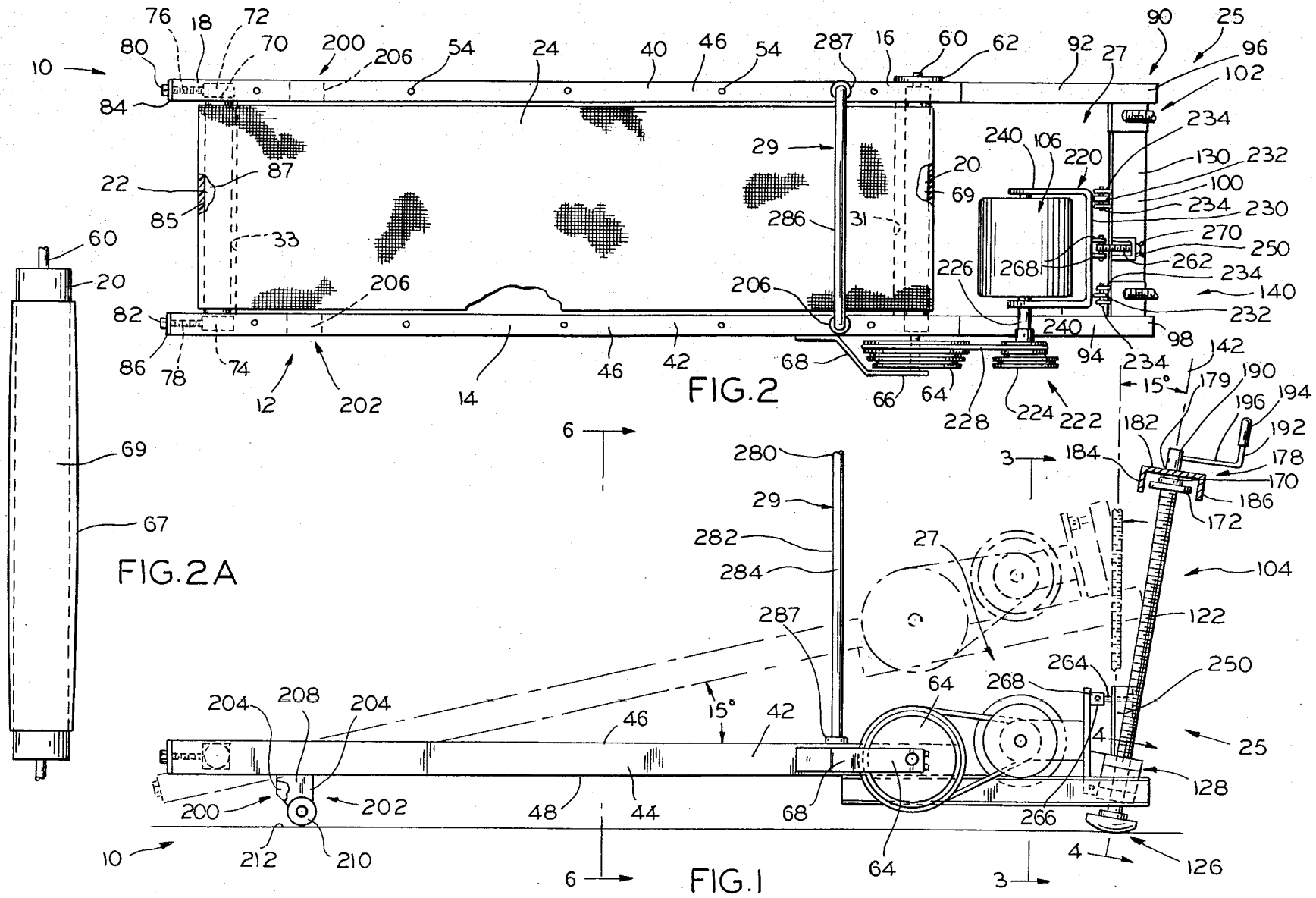
FIG. 1 is a side elevational view diagrammatically illustrating one embodiment of the invention, showing the treadmill assembly in full lines at its zero slope position, and in phantom in its maximum slope position for the illustrated embodiment, which is 15 degrees relative to the horizontal or a twenty-five percent grade.
FIG. 2 is a top plan view of the treadmill assembly as shown in its full line position of FIG. 1, with parts broken away.
FIG. 2A is a plan view of the treadmill head roller, diagrammatically illustrating its crown.
Figure 3:
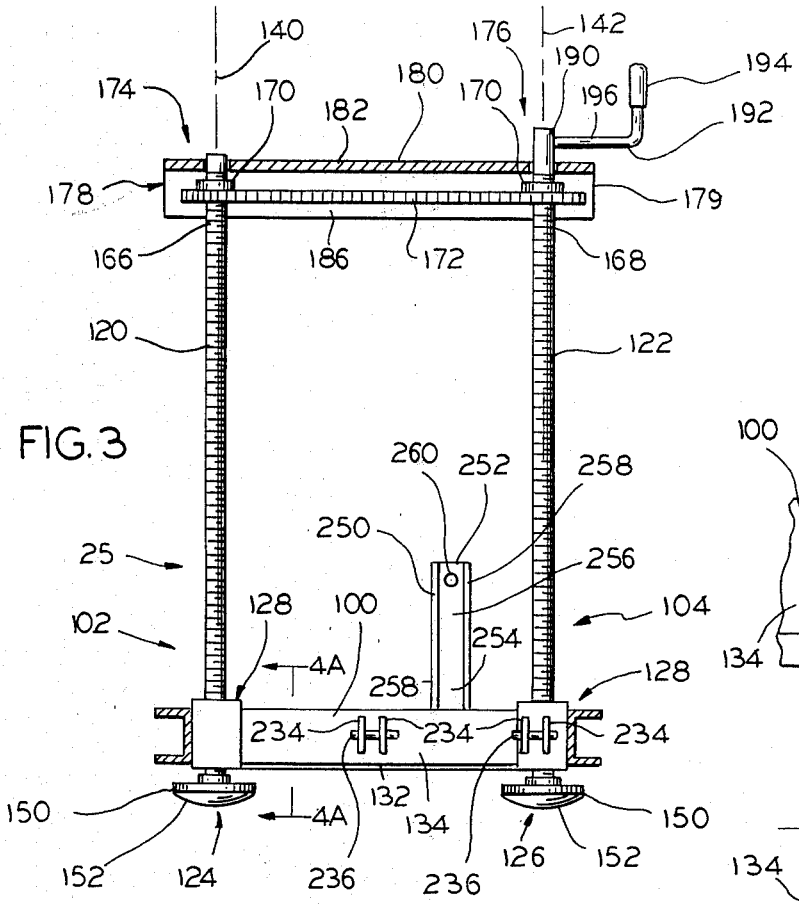
FIG. 3 is a vertical sectional view taken substantially along line 3—3 of FIG. 1, but with the operating motor assembly omitted to simplify the drawing.

Reference numeral 10 of FIGS. 1 and 2 generally indicates a diagrammatically illustrated embodiment of the invention in which the treadmill apparatus or unit 10 generally comprises a flat or planar frame 12 including a slider bed 14 extending between the head end 16 of the frame and the tail end 18 of the frame, head roller 20 that is journalled at the head or front end 16 of the frame, tail roller 22 that is journalled at the tail or back end 18 of the frame, and endless belt 24 that is trained over the slider bed 14 and the head and tail rollers 20 and 22. The frame 12 is equipped forwardly of head roller 20 with a slope adjusting device 25, whereby the user may manually adjust the slope of the treadmill between the two positions indicated in FIG. 1, and belt drive apparatus 27 that is carried by frame 12. Frame 12 also is equipped with conventional hand hold 29.

The slider bed 14 comprises a flat or planar sheet of plywood or the like 26 of rectangular outline and proportioned to extend substantially between the locations of the head roller 20 and the tail roller 22, with the slider bed ends being indicated in FIG. 2 at 31 and 33. The slider bed 14 has an upwardly facing fabric surfacing 30 provided by a sheet 32 of cotton duck canvas or the like suitably affixed to sheet 26 (by bonding or the like). The canvas should be dry and free of any lubricant materials of either the wet or dry types.

The belt 24 is preferably formed from nylon, Delrin, or the like. The belt 24 may also be formed from the molybdenum disulphide filled nylon product sold under the brand name Nylatron GS by the Polymer Corporation of Reading, Pennsylvania. It has been found that using the nylon belt in combination with the canvas slider bed surfacing 30 and free of any dry or wet lubricant surprisingly provides a support for the belt upper run that has better antifriction characteristics than if the canvas were impregnated with such substances as wax or graphite. A coefficient of friction on the order of 0.14 is readily provided by the Applicant's nylon belt-dry canvased slider bed surfacing arrangement. This is a significant factor in minimizing drive power requirements and bearing stresses of rollers 20 and 22.

The frame 12 further comprises a pair of opposed channel members 40 and 42 each of which comprises web portion 44 and spaced flanges 46 and 48. The slider bed 14 is formed to define longitudinally extending side edges 50 and 52 over which and against the respective frame members 40 and 42 are applied, with suitable bolts or screws 54 anchoring the slider board 14 (as equipped with the surfacing 30) to the frame members 40 and 42 at spaced points along the treadmill frame.

The head roller 20 of treadmill 10 is suitably keyed to or fixed on suitable shaft 60 having one of its ends journalled in suitable bearing 62 secured to the frame member 40 and its other end extended to have keyed thereto stepped drive pulley 64 and be journalled in extension 66 of suitable mounting bracket plate 68 affixed to the frame member 42, as by welding. As shown in FIG. 2A, roller 20, which is formed from steel or the like, is provided with a crown 67 formed from a suitable elastomer molded in place on roller 20, for belt centering purposes and provides for increased coefficient of friction of the roller surfacing that engages the belt 24. Crown 67 has a length that approximates the width of belt 24 and defines crowned surfacing 69 of a shaping suitable for belt centering purposes.

The tail roller 22 is also formed from steel or the like and includes suitable shaft 70 (to which it is suitably keyed or fixed having its ends journalled in the respective suitable bearings 72 and 74 that are threadedly connected to the respective bolts 76 and 78 having their respective heads 80 and 82 seated against the respective abutment plates 84 and 86 suitably affixed to the ends of the frame members 40 and 42 at the tail end 18 of the frame 12, to provide for movement of the tail roller 22 relative to the head roller 20 to tension the belt 24 as desired. Tail roller 22 includes crown 85 that is similar to head roller crown 67 and thus provides elastomeric crown surface 87.

A critical aspect of the invention is Applicant's discovery that the loads on the bearings in which the head and tail rollers 20 are journalled may be minimized when using nylon or the like belting by crowning such rollers with a suitable elastomer, while retaining the basic metallic roller structure for strength and rigidity. Applicant's invention contemplates that to achieve desirable minimumization of the loads on the bearings in which rollers 20 and 22 are journalled, the static coefficient of friction of the elastomeric crowning material to nylon should be a minimum of 0.3. Tests have shown that, for instance, nitrile rubber (50 durometer) relative to nylon has static and dynamic coefficients of friction of about 1.36 and 1.25, respectively, neoprene (65 durometer) has corresponding coefficients of friction of about 1.31 and 0.627, respectively, SBR butadiene (65 durometer) has corresponding coefficients of friction of about 0.89 and 0.58, respectively, and gum rubber (35 durometer) has corresponding coefficients of friction of 0.37 and 0.35, respectively; these and other equivalent elastomers thus provide at least the indicated minimum coefficient of static friction and satisfy the invention requirements for use as the roller crowning. The result is that the frame 12 and the bearings for rollers 20 and 22 may be greatly simplified and of inexpensive design by reason of the substantial minimumization of the bearing stress requirements. The nitrile rubber is preferred since it has a relatively high coefficient of dynamic friction as a back up should belt slippage occur.

Similar tests have also shown that the static and dynamic coefficients of friction of nylon belting to sheet steel are both about 0.235, and that the corresponding coefficients of friction of nylon belting to Delrin are both about 0.235.

Frame 12 at its head end 16 includes extension section 90 comprising a pair of channel members 92 and 94 respectively affixed to the undersides of the respective frame members 40 and 42 in parallel coplanar alignment with same, as by bolting which project forwardly of the head roller 20, and at their respective projecting ends 96 and 98 have affixed therebetween cross member 100 which mounts the slope adjusting device 25. Device 25 comprises a pair of slope adjusting support devices 102 and 104. The drive motor 106 (and associated parts) for driving belt 24 comprising drive apparatus 27 are also mounted on frame extension section 90.

The general arrangements of the cross member 100 and its slope adjusting support devices 102 and 104 is of special significance. As indicated in FIG. 1, it is a feature of the invention that for zero slope conditions, the slope adjusting devices 102 and 104 are to be in their retracted positions, but when the treadmill is elevated to its maximum design height, the devices 102 and 104 are to be in their extended positions relative to the frame 12 for slope defining purposes. It is apparent that for the treadmill 10, when in its maximum slope defining position, its stability needs for the head end of the frame 12 are maximum, while in its zero slope defining position (the full line position of FIG. 1), its stability needs are minimal.

The present invention contemplates that the treadmill assembly 10 will provide for a repositioning of the slope adjusting devices 102 and 104, which incidentally are the only means of support of the treadmill 10 at its forward end, so as to improve the stability they provide, as the treadmill position of maximum slope is approached and reached, in accordance with the increasing need for stabilization as the frame head end elevates. For this purpose, the Applicant's arrangement contemplates that the slope adjusting devices 102 and 104 will be disposed to operate about upright axes that are at an acute angle off perpendicular or normal relation with the plane of the slider bed 14, which acute angle is equal to the acute angle of the slider bed 14 relative to the horizontal that will provide the maximum slope of operation of the treadmill 10. Further, the slope adjusting devices 102 and 104 are to be of sufficient length to elevationally move cross member 100, and thus the treadmill frame 12 to the indicated slope maximum, while at the same time shifting the slope adjusting devices 102 and 104 from the forwardly angled relation, upwardly of the treadmill, that is illustrated in the full line showing of FIG. 1, to the substantially vertical relation that is illustrated in the phantom line position of FIG. 1, which disposes the slope adjusting members 102 and 104 for maximum bracing relation relative to the frame 12 and its extension 90.

Figure 5:
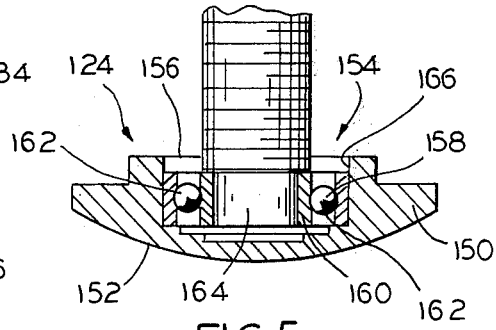
FIG. 5 is a fragmental sectional view of the lower end of one of the treadmill slider bed supporting screw members, illustrating its supporting foot and the manner in which the screw member is journalled in same, in the embodiment of FIGS. 1 and 2.
Figure 7:
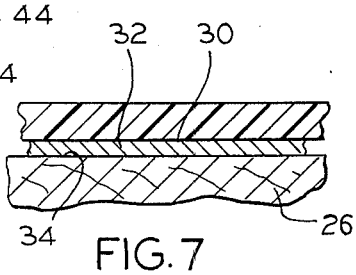
FIG. 7 is a fragmental view on an enlarged scale illustrating a sectional view through the slider bed and showing the canvas sheeting that forms the slider bed top surfacing across which the upper run of the belt rides.

In the specific arrangement illustrated for the embodiment of FIGS. 1–7, this aspect of the invention is provided by way of slope adjusting devices 102 and 104 each comprising the respective screw or threaded members 120 and 122 that are respectively equipped with the respective feet 124 and 126 in the manner diagrammatically illustrated in FIG. 5 for the foot 124. The threaded members 120 and 122 are each respectively threadedly mounted in cross member 100 by a stationary nut structure 128 that may be of any suitable type, one form of which is diagrammatically illustrated in FIG. 4.

Figure 4:
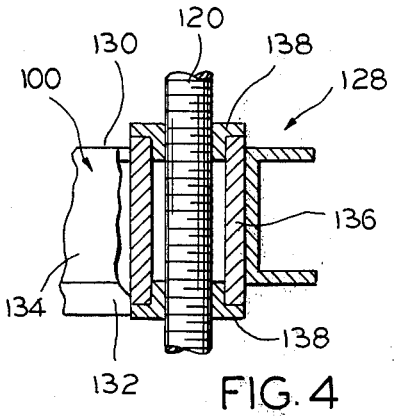
FIG. 4 is a fragmental view taken substantially along line 4—4 of FIG. 1, diagrammatically illustrating the manner in which the screw members may be threadedly mounted in the treadmill cross member.
Figure 4A:
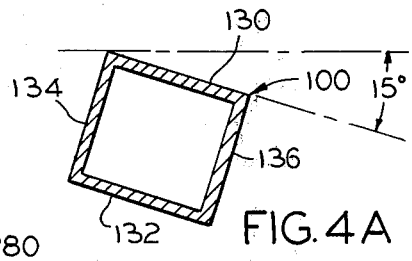
FIG. 4A is a fragmental sectional view taken along line 4A—4A of FIG. 3, on an enlarged scale.
Figure 6:
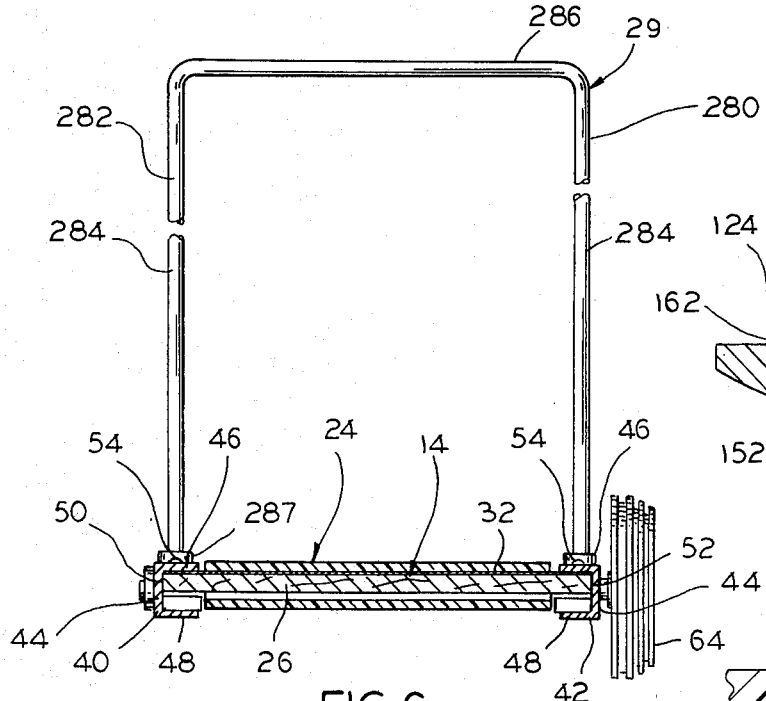
FIG. 6 is a vertical cross-sectional view taken substantially along line 6—6 of FIG. 1, illustrating the general arrangement of the slider bed and belt that is trained over same.

In the specific form illustrated, cross member 100 is of quadrilateral tubular transverse cross-sectional configuration (approximately square in the illustrated embodiment) and defines top wall 130, bottom wall 132, rear wall 134 and forward wall 136, as illustrated in FIG. 4A.

The nut structures 128 each comprise in the illustrated form a tubular member or shell or sleeve 136 of quadrilateral transverse cross-sectional configuration (square in the illustrated embodiment) with shells 136 suitably fixed to either end of the cross member 100, as by employing welding, so as to be an integral part of the cross member 100. Each shell 136 has applied to either end of same nut elements 138 that are formed, for instance, from the aforementioned Nylatron 65 product, and fixed to the sleeve 136 in any suitable manner (as by employing bonding or suitable fasteners, not shown) and that are suitably internally threaded and oriented to complement the threading of the respective threaded members 120 and 122 for threaded relation thereto. Suitable acme type threads may be employed for this purpose, as an example.

The nut structures 128 are fixed to the cross member 100 (and thus are a part of same) so that the axes of rotational operation 140 and 142 of the respective devices 102 and 104 will be perpendicular to the top and bottom walls 130 and 132 of the cross member 100 and be centered between the side walls 134 and 136 of same (as indicated by the showing of FIG. 1). However, the cross member 100 and the nut devices 128 affixed thereto at either end of same are secured to the respective extension side members 92 and 94 in angled relation thereto, as is also indicated in the showing of FIG. 1 as well as FIG. 4. In this angled relationship, in which (in the form of FIGS. 1–7) the sleeves 136 of the respective nut devices 128 are affixed to the respective extension side members 92 and 94, as by employing welding, the cross member 100 and its associated nut devices 128 are oriented relative to the plane of the slider bed 14 and its frame 12 so that the top and bottom walls 130 and 132 of the cross member are angled at an acute angle relative to the plane of slider bed 14 and frame 12, with the result that the axes of rotational operation 140 and 142 of the respective slope adjusting devices 102 and 104 are angled at the same acute angle off the vertical when the frame 12 is horizontally disposed. In this position of the frame 12, the operational axes 140 and 142, in addition to lying in parallel vertical planes that extend longitudinally of the frame 12, also project forwardly of the unit 10 upwardly of the frame 12.

As has been indicated, the treadmill assembly 10 is arranged and proportioned to provide a maximum slope of twenty-five percent in its position of maximum inclination, which translates into an angulation of approximately 15 degrees relative to the horizontal, as indicated in FIG. 1. In accordance with the invention, the cross member 100 and its nut devices 128 are fixed to frame 12 to dispose its top and bottom walls 130 and 132 at an angle of approximately 15 degrees relative to the plane of the frame 12, and thus dispose the operating axes 140 and 142 of devices 102 and 104 at an angle of approximately 15 degrees off the vertical when the frame 12 is in its horizontal relation shown in FIG. 1.

As has also been indicated, the respective screw members 120 and 122 are journalled in their respective feet 124 and 126, which are diagrammatically illustrated in FIG. 5 in the specific showing of foot 124. Thus, the feet 124 and 126 each comprise a rounded body 150 having a spherically contoured floor engaging surface 152 struck on a relatively large radius, such as a $2\frac{1}{2}$ inch radius, and formed to define a centrally located socket 154 into which is suitably secured a conventional ball bearing assembly 156, diagrammatically illustrated as comprising outer race ring 158, inner race ring 160, and suitable bearing balls 162 separating the race rings. Race ring 160 suitably receives the reduced end portion 164 of the threaded member 120 or 122 to which the foot is attached, and race ring 158 is suitably secured to the foot body cylindrical side wall 166 that defines the socket 154. Force fitting or employing a suitable adhesive may be employed for these purposes.

The threaded members 120 and 122 at their upper ends are each equipped with a chain drive sprocket 170 over which endless drive chain 172 is trained. The upper ends 166 and 168 of the respective threaded members 120 and 122 are also suitably journalled, as indicated at 174 and 176 in chain drive cover 178.

The cover 178 as illustrated comprises a shield 179 in the form of channel shaped member 180 having web portion 182 in which the upper ends 168 of the respective threaded members 120 and 122 are journalled, and depending side flanges 184 and 186 which extend downwardly sufficiently from the web portion to overlie and mask drive chain 172. In the form shown, the channel member 180 is of sufficient length to cover both ends of the drive chain 172 as it is disposed in trained relation over the sprockets 170, but if so desired, the cover member 170 could be provided with rounded end portions that join the cover flanges 184 and 186 at either end of the cover 178.

The upper end 168 of the threaded member 122 is extended where indicated at 190 and has removably applied to same crank handle 192 comprising hand gripping portion 194 at right angles to stem portion 196 which in turn is suitably removably received in a bore formed in the end portion 190 in close fitting, radial relation thereto.

It will thus be observed that by rotating operating handle 192 about the operating axis 142 of the threaded member 122, both the devices 102 and 104 will be simultaneously operated about their respective operational axes 140 and 142 by way of the coupling provided by drive chain 172 and the cooperating sprockets 170. Thus, the threaded members 120 and 122 may be turned in one direction about their respective axes 140 and 142 to shift the frame 12 from its horizontally disposed position of FIG. 1, in which the devices 102 and 104 are in their retracted relations, to the maximum slope position shown in the phantom line position of FIG. 1, in which the devices 102 and 104 are in their extended relations. As already indicated the threaded members 120 and 122, in moving from the full line position of FIG. 1 to the phantom line position thereof, rock rearwardly of the treadmill from the upwardly angled relation shown in the full line position of FIG. 1 to the substantially vertical relation shown in the phantom line position of FIG. 1.

Rotation of the threaded members 120 and 122 in the opposite direction returns the treadmill to the full line position of FIG. 1, whereby the devices 102 and 104 are returned from their extended relations to their retracted relations. Regardless of which direction the members 120 and 122 are operated, their threaded connections with the frame cross member 100 through nut devices 128 move the cross member 100 longitudinally of the respective members 120 and 122 to achieve the changes of slope of the treadmill 10 as may be desired.

The frame 12 at its rear end 18 is equipped with a pair of leg structures 200 and 202. In the form diagrammatically illustrated, each device 200 and 202 comprises an angle bracket 204 (see FIG. 1) having its upper flange 206 suitably affixed to the underside of the respective frame members 40 and 42, as by employing welding, and its depending flange 208 having a roller 210 suitably journalled thereon. The foot structures 200 and 202 (which are the same in arrangement, though only foot structure 202 is fully shown), and the feet 124 of the respective devices 102 and 104 are proportioned such that when the treadmill assembly 10 rests on horizontal supporting surface 212 (that is intended to represent a floor or the like), and the slope adjusting devices 102 and 104 are in their retracted relations, the frame 12 and its slider bed 14 will be horizontally disposed.

The drive motor 106 comprises any suitable electrically driven motor arranged in a suitable manner for connection to an appropriate source of electrical energy (not shown). The motor 106 is mounted in support frame 220 that is pivotally connected to cross member 100 to permit proper tensioning of step drive assembly 222.

The step drive assembly 222 comprises suitable stepping sprocket 224 mounted on and keyed to motor shaft 226 in proper coplanar alignment with stepping sprocket 64 that is keyed to shaft 60, with pulley belt 228 being optionally applied to the sets of coplanar related pulley grooves of the pulleys 64 and 224 such that the belt 24 will be driven at one of the speeds indicated, namely 2.5, 3, or 3.5 miles per hour, at the user's option. These speeds are suitable for walking exercise purposes. As slider bed surfacing 32 has a coefficient of friction of about 0.14 relative to a belt 24 formed from Nylon, and the elastomeric crowning of the head and tail rollers maximizes the coefficient of friction between the belt 24 and rollers 20 and 22, a one-third horsepower motor will satisfy the power requirements for a two hundred pound individual using treadmill 10, for example.

The motor support 220 comprises web portion 230 fixedly equipped with a pair of lugs 232 that are respectively journalled between the sets of lugs 234 that are suitably affixed to the side wall 134 of the cross member 100, as by employing suitable pins 236. The motor support 220 also includes spaced side flanges 240 embracing motor 106 between which the motor 106 is suitably mounted.

Affixed to the cross member 100 is an upright post 250 in the form of channel member 252 that has its lower end 254 affixed to the top wall 130 of the cross member 100, as by employing welding. The channel member 252 defines web portion 256 in spaced rigidifying flanges 258. The web portion 256 is formed with aperture 260 through which extends the threaded shank 262 of screw member 264 which is pivotally connected by suitable pin 266 between spaced lugs 268 that are fixed to a web portion 230 of the motor carrier 220. Suitable wing nut 270 applied on the forward facing side of the post web portion 256 is threadely operated on the threaded member 264 to swing motor support 220 about its pivot pins 236 as needed to properly tension pulley belt 228 when it has been applied to the step pulley grooves that will provide the belt drive speed selected by the user.

The hand hold 29 of treadmill 10 comprises a fixed railing 280 that is in the form of brace member 282 suitably shaped from rod or pipe stock to define upright legs 284 and rectilinear bight or hand hold portion 286. The legs 284 are anchored to the respective frame members 40 and 42 by suitable mounting plates 287 to dispose the hand rail 280 in upright inverted U relation extending crosswise and perpendicular to frame 12. Legs 284 are proportioned in length so that the user when mounting and working out on the treadmill apparatus may grasp the hand rail 280 as needed to steady himself.

FIGS. 8–11 illustrate a basically similar treadmill assembly 10A that is quite similar to assembly 10 in many respects, but represents the preferred embodiment of the invention. As many of the components of the apparatus 10A also form a part of the apparatus 10, the description of apparatus 10A will be limited primarily to the modified features of apparatus 10A. Reference numerals employed in the drawings that are common to the embodiments 10 and 10A indicate like parts.

The treadmill apparatus or unit 10A generally comprises a flat or planar frame 12A that includes slider bed 14 and its fabric surfacing 30, with the slider bed 14 having head roller 20A (see FIG. 9) at the head end 16 of frame 12A and tail roller 22A at the tail or back end 18 of the frame 12A, with endless belt 24 being trained over the slider bed 14 and the head and tail rollers 20A and 22A in the same manner as apparatus 10. The frame 12A is equipped forwardly of the head roller 20A with slope adjusting device 25 and belt drive apparatus 27. Apparatus 10A is also equipped with a modified hand hold device 29A (see FIGS. 8 and 9).

Figure 9:
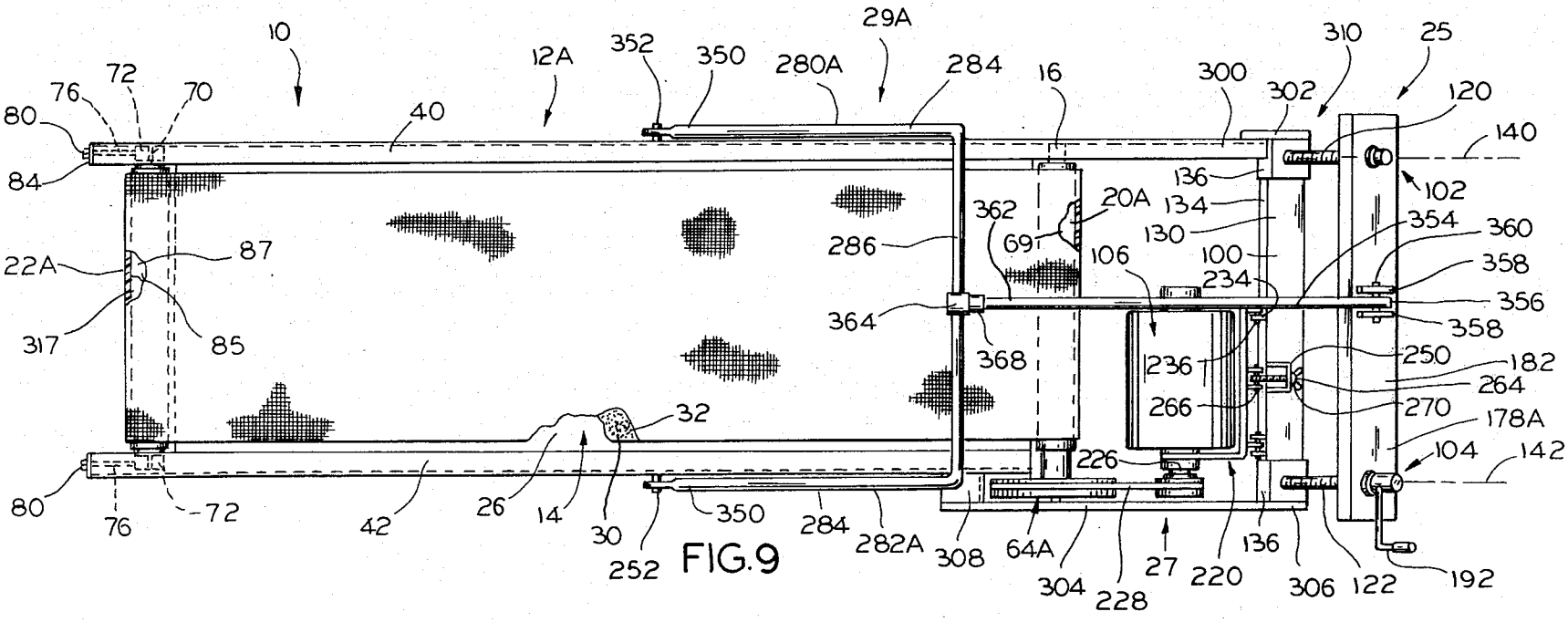
FIG. 9 is a top plan view of the treadmill embodiment shown in FIG. 8, with the treadmill frame in its horizontal position.
Figure 11:
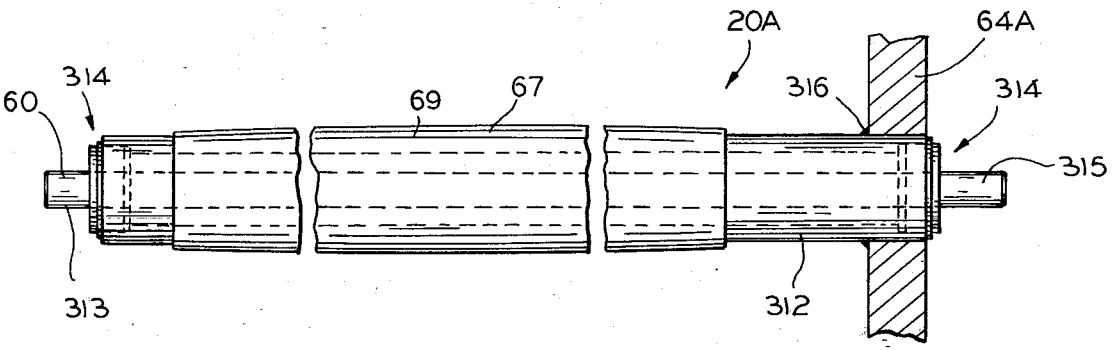
FIG. 11 is a fragmental plan view of the treadmill head roller and its associated drive pulley of the embodiment of FIGS. 8–10, with parts broken away.

As indicated, the slider bed 14 of apparatus 10A is essentially the same as in apparatus 10. Slider bed 14 of apparatus 10A thus includes the sheet 26 of plywood or the like to which the lubricant free fabric surfacing 30 is applied in the form of canvas sheet 32 that may be of the common cotton duck type. In the apparatus 10A, the frame channel member 40 at the head end 16 of the frame extends straight down forwardly of the frame at end 16 for affixing to the nut structure shell or sleeve 136 of the cross member 100 at that side of the frame. Thus, as indicated in FIG. 9, the extended end 300 of member 40 abuts the shell 136 in question, with reinforcing plate 302 being affixed to both these components, as by employing welding, with the end 300 being affixed to the indicated shell 136 by welding.

On the channel member 42 side of frame 12A, at the head end 16 of the frame 14A, mounting plate 304 is provided which has its forwardly projecting end 306 affixed to the other cross member shell or sleeve 136 as by employing welding, and the other end of same affixed to the channel member 42 by employing a fabricated connecting block 308 that is welded or otherwise secured to both plate 304 and channel 42 at its web portion 44.

Figure 8:
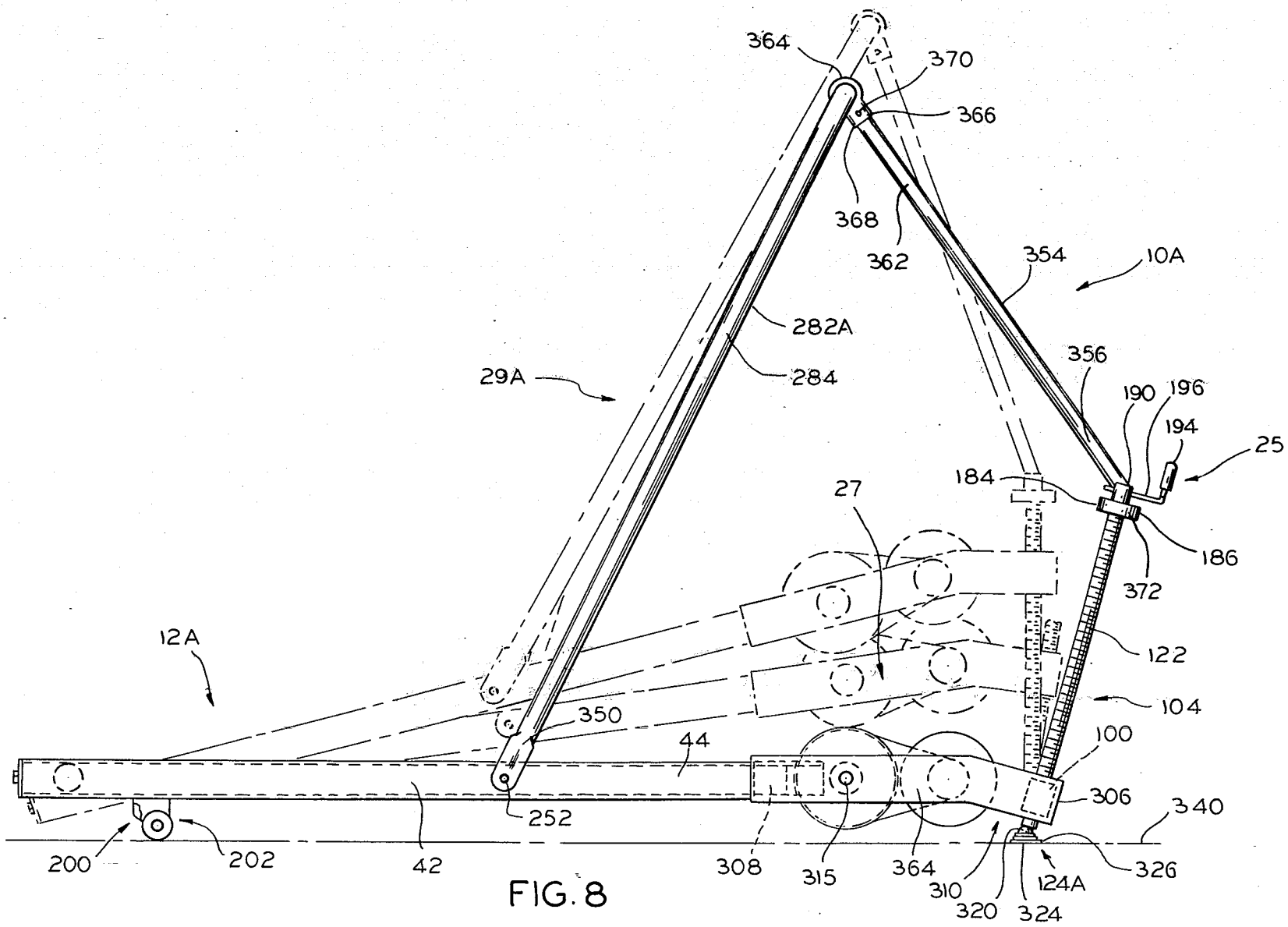
FIG. 8 is a view similar to that of FIG. 1, illustrating a preferred embodiment of the invention.

In the treadmill apparatus 10A, the projecting end 300 of the channel member 40 and the forwardly extending end 306 of the plate 304 are downwardly angled from the plane of the frame 12A at an angle of 15 degrees to achieve the aforementioned angulation of the cross member 100 relative to the horizontal that has been described in connection with the treadmill apparatus 10. The frame 12A thus defines a downwardly angled forward end portion 310 that lies in a plane that is at an angle of 15 degrees relative to the plane of the basic frame 12A, as indicated in FIG. 8. Cross member 100 in treadmill 10A thus is joined in the frame 14A to have its top and bottom walls 130 and 132 parallel to the plane of the frame portion 310, but at an indicated angle of 15 degrees relative to the plane of the basic frame 12A, as indicated in FIG. 8.

In the apparatus 10A, the head roller 20A comprises (see FIG. 11) roller shell 312 journaled on the shaft 60 by suitable ball bearing units 314 at either end of same. Shaft 60 is suitably secured in channel member 40 at one of its ends 313 and the plate 304 at its other end 315, with suitable step drive pulley 64A being received over one end of the shell 312 and welded thereto as indicated at 316.

The head roller 20A includes the crown 67 and its crown surfacing 69 that is employed in connection with the head roller 20.

The tail roller 22A is arranged in the same manner as the head roller 20A, except of course, its shaft 70 has its ends suitably mounted in the respective channel members 40 and 42, and, of course, the tail roller 22A is free of pulley 64A. Tail roller 22A thus includes a shell 317 that is similar to shell 312 of head roller 20A, but suitably proportioned in diameter for tail roller use, to which is applied the crown 67. The mounting of the ends of the shaft 70 of the tail roller as to the frame 12A is the same as in apparatus 10, as indicated by corresponding reference numerals.

Figure 10:
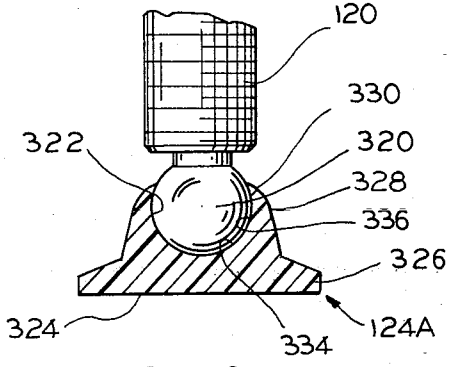
FIG. 10 is a fragmental sectional view similar to that of FIG. 5, but illustrating the screw member foot arrangement of the embodiments of FIGS. 8 and 9.

As indicated, at the head end 16 of frame 12A the extension section 90 of the apparatus 10 is replaced by the projecting end portion 30 of the channel member 40 and the mounting plate 304, between which the cross member 100 is applied. The cross member 100 is equipped with the aforedescribed slope adjusting support devices 102 and 104 that have the same features and function as in the apparatus 10, as indicated by the two position showings of FIG. 8. Thus, the slope adjusting devices 102 and 104 of the apparatus 10A are essentially the same as in the apparatus 10, they comprising the screw or threaded members 120 and 122 that are in threaded relation to the nut structures 128, that are operated in the same manner to comprise a slope adjusting device 25. In the apparatus 10A, the slope adjusting support devices 102 and 104 are equipped with modified feet 124A arranged as shown in FIG. 10 for the device 102. Thus, the threaded members 120 and 122 at their lower ends are formed with a ball terminal portion 320 which is received in the socket 322 of foot 124A that is formed from a suitable plastic material such as polyethylene or polypropolene. The foot 12A defines a planar floor engaging surface 324 that forms one side of disc portion 326, with the socket 324 being defined by an annular wall structure 328 projecting from the disc portion 326 that tapers upwardly of the disc portion 326 into a resiliently flexible continuous lip 330 which is proportioned such that the ball terminal portion 320 may be snap fitted into the socket 322 for permanent retention of the foot 124 on the ball 320. The foot 12A defines the internal conical surface 334 against which the ball portion 320 rockably and rotatably engages, and upstanding annular wall surface 336 that confines the ball 320 centrally of the foot 12A.

Thus, the slope adjusting support devices 102 and 104 as equipped with the feed 124A are rotatably and rockably mounted within the respective feet 124A which in turn have their undersurfaces 324 in flush engagement with the apparatus supporting surface 340.

The frame 12A at its rear or tail end 18 is shown equipped with the leg structures 200 and 202 of the apparatus 10. The leg structures 200 and 202 and the feet 124 of the devices 102 and 104 are proportioned such that when frame 12A is in its horizontally disposed position, which is the retracted relation of the devices 102 and 104, the screw members 120 and 122 of the respective devices 102 and 104 will have the angular relationship relative to the horizontal that has been described in connection with the apparatus 10. When the devices 102 and 104 are in their extended relations, the frame 12A will be disposed at the indicated 15 degree angle relative to the horizontal, while the screw members 120 and 122 will be substantially threadedly disposed, as indicated in FIG. 8, similar to the arrangement of apparatus 10; frame portion 310 under this condition is horizontally disposed.

The drive apparatus 27 of apparatus 10A is the same as in treadmill 10, with a simplified form of pulley belt coupling arrangement of a conventional type being diagrammatically illustrated in FIG. 9.

The hand hold 29A of the treadmill apparatus 10A comprises an adjustably mounted railing 280A in the form of a U shaped brace member 282A, that defines legs 284 and rectilinear bight portion 286, of which the lower ends 350 of the legs 284 are pivotally connected to the frame 12A, and specifically its channel members 40 and 42, by employing suitable pins 252. A hand hold positioning strut member 354 has its lower end 356 pivotally connected to and between spaced lugs 358 that are suitably fixed to the cover 178A, and specifically its web portion 182, by suitable pin 360; the upper end 362 of the strut 354 is suitably pivotally connected to brace member 282A and specifically its bight portion 286. In the form shown, this is effected by applying sleeve 364 in close fitting pivoting relation to the bight portion 286 and suitably affixing the end 362 of the strut member 354 thereto. One way of doing this would be to affix a short strut 366 to the sleeve 364, as by employing welding, for insertion in a socketed terminal portion 368 of the strut end 362, and pinning the two together as where indicated at 370 in FIG. 8.

The cover 178A and associated parts are the same as cover 178 except for the application thereto of the lugs 358 and the provision of depending end flanges 372 at the ends of the cover 178 that join the cover flanges 184 and 186 together at the ends of the cover 178A.

It will be apparent that in the apparatus 10A, rotation of operating handle 192 about the axis 142 of threaded member 122 will simultaneously operate both the slope adjusting support devices 102 and 104 in the manner already described. Thus, the threaded members 120 and 122 of the apparatus 10A may be turned in one direction about the respective axes 140 and 142 to shift the frame 12A from its horizontally disposed full line position of FIG. 8, in which the devices 102 and 104 are in their retracted relations, to the maximum slope position shown in the phantom line showing of FIG. 8, in which the devices 102 and 104 are in their extended relations, and frame 12A is disposed at an approximate 15 degree angulation with respect to the horizontal, with its frame portion 310 horizontally disposed and the threaded members 120 and 122 of the respective devices 102 and 104 positioned substantially vertically, and having been rocked rearwardly of the treadmill from their upwardly angled relation shown in the full line position of FIG. 8.

As to the self adjusting hand hold 29A, its function is to maintain its bight portion 286, that is normally the part of same that is grasped by the user when the treadmill is being used for exercise walking purposes, at substantially the same relative position to the user even though the frame 12A will be upwardly inclined at an angulation that will depend on the slope the user wishes to exercise at, up the maximum twenty-five per cent slope provided by the illustrated embodiments. The showing of FIG. 8 illustrates the two limit positions that the hand hold 29 can articulate between as the treadmill 10A is moved between its horizontal relation and its position of maximum slope, from which it will be observed that as the frame 12A is shifted from its horizontal relation to its position of maximum slope, the brace member 282A and its positioning strut 354 articulate to bring the brace member bight portion 286 forwardly of the frame in rough proportion to the degree of angulation of the frame 12A off of horizontal positioning.

Operation of the devices 102 and 104 in the oppposite direction rotates the threaded member 120 and 122 thereof in the opposite direction to return the treadmill to its full line relation indicated in FIG. 8, whereby the devices 102 and 104 are returned from their extended relations to the retracted relations.

It will thus be seen that the treadmill assembly of the present invention provides a simplified, complication free exercise apparatus suitable for walking exercise at the pace and slope rate desired by the user. The slider bed and frame construction therefor are of minimal and simplified components arranged for ready securement together and rugged resistance to hard use. Jogging or trotting use may be provided for by providing a drive apparatus that will move the belt 24 at selected speeds of up to five miles per hour.

The assemblies 10 and 10A require no instrumentation and the simplified nature of the belt drive permits ease of manual adjustment for speed changes and off-on operation. The simple canvas slider surface for the nylon belt slider bed provides coefficient of friction characteristics that are lower than of the canvas where coated or impregnated with wax, graphite, or the like, while also eliminating the messiness that can accompany the use of such materials. The elastomeric belt roller crowning increases the static coefficient of friction of the rollers relative to the belt to levels that insure minimal bearing stresses.

The supporting feet for the assemblies 10 and 10A in the zero slope position of FIGS. 1 and 8 are highly effective in maintaining stability in use, with the angulation of the threaded members 120 and 122 in the zero slope position of the apparatus being of no significant effect due to the disposition of the cross member 100 in close adjacency to the feet of devices 102 and 104. As the treadmill apparatus is elevated to its maximum slope position, the slope adjusting devices 102 and 104 shift toward and to the stabilizing and vertically disposed position indicated in the phantom showings of FIGS. 1 and 8.

Operation of the slope adjusting devices 102 and 104 is easy and effective, with the threaded mounting of the threaded members 120 and 122 in the cross member 100 and the journalling of their upper ends in cover 178 maintaining the threaded members 120 and 122 in uniform spaced apart parallel relation for effective simultaneous operational movement about their respective axes 140 and 142.

The proportioning and simplified nature of the treadmill assembly 10 makes it practical for the individual user to use and store same in his home. Shifting of the assembly is easily done by picking up the head end of same and pushing or pulling as needed. The treadmill 10, when positioned as shown in FIG. 1, the head end of the assembly may be rolled sidewise due to the off center engagement that feet 124 and 126 have with the floor surface 212.

The hand hold 29A is articulated to adjust its hand hold portion forwardly of the apparatus 10A as the frame 12A is shifted from zero slope relation to its maximum slope relation so that the user will be able to use the exerciser at the same relative position lengthwise of belt 24 despite the increased slope setting employed.

The foregoing description and the drawings are given merely to explain and illustrate the invention and the invention is not to be limited thereto, except insofar as the appended claims are so limited, since those skilled in the art who have the disclosure before them will be able to make modifications and variations therein without department from the scope of the invention.

I claim:

1. An exercise treadmill comprising:

a generally planar slider bed having a head end, a tail end, and a fabric top surfacing extending substantially between said ends thereof, an endless belt trained over said slider bed defining an upper belt run overlying said slider bed top surface and a lower run passing under said slider bed, means for driving said belt for movement of said belt upper run from said head end to said tail end of said slider bed, said slider bed having secured to same adjacent said head end thereof a cross member extending transversely thereof, a pair of screw members threadedly mounted in said cross member in spaced apart relation and for rotation about upright axes that are in parallelism and that are inclined at like acute angles off perpendicular relationship relative to the plane of said slider bed, said axes each lying in a plane extending normally and longitudinally of said slider bed and being angled relative to the plane of said slider bed to extend forwardly of said slider bed upwardly of said slider bed plane, each of said screw members having a foot journalled thereof, said slider bed having spaced feet adjacent its tail end, said screw members each having threaded portions of substantially equal lengths, and means for simultaneously rotating said screw members in the same direction in forward and reverse directions for threading said cross member longitudinally of said screw member threaded portions to raise and lower said slider bed head end, said feet being proportioned to support said slider bed with said plane thereof horizontally disposed when said screw members are in their retracted positions relative to said cross member with the screw member threaded portions thereof being largely disposed above said cross member, said screw member threaded portions being proportioned in length such that when said screw member threaded portions are in their extended positions relative to said cross member, with said screw member threaded portions thereof being largely disposed below said cross member, said screw members shift relative to the vertical to be disposed substantially vertically and in firm supporting relation to the slider bed with the slider bed disposed at the same said acute angle value with respect to the horizontal so as to be in the maximum grade effect position, said screw members in their said retracted positions being at said acute angle relative to the off perpendicular relationship to the plane of said slider bed and said screw members in their said extended positions being substantially vertically disposed, said belt being formed from nylon and said top surfacing being canvas that is free of lubricant.

2. The treadmill set forth in claim 1 wherein:

said slider bed at its head and tail end has head and tail rollers journalled thereon, with said belt being trained over said rollers, said rollers each having an elastomeric crown against which said belt bears providing a coefficient of static friction of at least 0.3.

3. The treadmill set forth in claim 1 wherein:

said slider bed includes a hand rail structure secured thereto of inverted U configuration that is disposed crosswise of said slider bed to present its bight portion above said belt for hand hold purposes.

4. The treadmill set forth in claim 3 wherein:

said hand rail structure is in fixed relation to said slider bed.

5. The treadmill set forth in claim 3 wherein:

said hand rail structure is pivotally connected to said slider bed in forwardly inclined relation thereto, with said screw members mounting a cover that rides on the upper ends of same in which said screw members are journalled, and a strut articulated between said cover and said hand rail structure bight portion for adjusting the position of said bight portion as said slider bed is shifted from its horizontal relation.

6. An exercise treadmill comprising:

a generally planar slider bed frame having a head end, and a tail end, said frame comprising a slider bed having a flat top surfacing extending substantially between said frame ends, a head roller journalled in said frame at said frame head end, a tail roller journalled in said frame at said frame tail end, a nylon belt trained over said rollers and across said slider bed and defining an upper belt run overlying said slider bed top surface and a lower run passing under said slider bed, said rollers being formed from rigid metallic material and each having a belt centering crown formed from an elastomeric material, said crowns each having a length that approximates the width of said belt, with said belt being centered on said roller crowns, means for driving said belt for movement of said belt upper run from said head end to said tail end of said slider bed, said frame having secured to same adjacent said head end thereof a cross member extending transversely thereof, a pair of screw members threadedly mounted in said cross member in spaced apart relation and for rotation about upright axes that are in parallelism and that are inclined at like fixed acute angles off perpendicular relationship relative to the plane of said slider bed, said axes each lying in a plane extending normally and longitudinally of said slider bed and being angled relative to the plane of said slider bed to extend forwardly of said slider bed upwardly of said slider bed plane, each of said screw members having a foot journalled thereon, said slider bed frame having spaced feet adjacent its tail end, said screw members each having threaded portions of substantially equal lengths, and means for simultaneously rotating said screw members in the same direction in forward and reverse directions for threading said cross member longitudinally of said screw member threaded portions to raise and lower said slider bed head end, said feet being proportioned to support said slider bed frame with said slider bed plane horizontally disposed when said screw members are in their retracted positions relative to said cross member with the screw member threaded portions thereof being largely disposed above said cross member, said screw member threaded portions being proportioned in length such that when said screw member threaded portions are in their extended positions relative to said cross member, with said screw member threaded portions thereof being largely disposed below said cross member, said screw members shift relative to the vertical to be disposed substantially vertically and in firm supporting relation to the slider bed with the slider bed disposed at the same said acute angle value with respect to the horizontal so as to be in the maximum grade effect position, said feet of said screw members including means for accommodating rock of said screw members rearwardly and forwardly of said frame when said screw members are operated to shift same between said retracted and extended positions thereof, said screw members in their said retracted positions being at said like acute angles relative to the off perpendicular relationship to the plane of said slider bed and said screw members in their said extended positions being substantially vertically disposed.

7. The treadmill assembly set forth in claim 6 wherein:

said rollers are formed from steel and said elastomeric material being nitrile rubber.

* * * * *